US007704080B2

(12) United States Patent
Naumann et al.

(10) Patent No.: US 7,704,080 B2
(45) Date of Patent: Apr. 27, 2010

(54) RECEIVING HOUSING FOR A HAND-HELD POWER TOOL

(75) Inventors: Thomas Naumann, Kaufering (DE); Helmut Burger, Moorenweis (DE); Claus Osselmann, Geltendorf (DE)

(73) Assignee: Hilti Aktiengesellschaft, Schaan (LI)

( * ) Notice: Subject to any disclaimer, the term of this patent is extended or adjusted under 35 U.S.C. 154(b) by 1001 days.

(21) Appl. No.: 11/444,697

(22) Filed: May 31, 2006

(65) Prior Publication Data

US 2006/0274981 A1 Dec. 7, 2006

(30) Foreign Application Priority Data

Jun. 1, 2005 (DE) ..... 10 2005 000 074

(51) Int. Cl.
*H01R 12/00* (2006.01)

(52) U.S. Cl. ..... 439/76.1; 439/276; 439/910; 439/936

(58) Field of Classification Search ..... 439/76.1, 439/910, 976, 276, 936
See application file for complete search history.

(56) References Cited

U.S. PATENT DOCUMENTS 5,187,328 A 2/1993 Burgess et al.
5,982,624 A * 11/1999 Onoda et al. ..... 439/76.1
2006/0201797 A1 9/2006 Rastemborski et al.

FOREIGN PATENT DOCUMENTS

CH 0665150 4/1988
DE 0157329 3/2003

OTHER PUBLICATIONS

Search Report, Oct. 2007.

* cited by examiner

*Primary Examiner*—Tho D Ta
(74) *Attorney, Agent, or Firm*—Abelman, Frayne & Schwab

(57) ABSTRACT

A receiving housing for a hand-held power tool includes a first housing part (13) having an opening (15), a board (20) with electronic component (17, 18, 19) arranged in the first housing part (13) at a distance (A) from the opening (15), and a second housing part (14) for closing the opening (15) and forming, together with the first housing part (13), a receiving space (16), with the second housing part (14) having at least one sleeve section (26) an axial length (L) of which at least corresponds to the distance (A) between the board (20) and the opening (15).

4 Claims, 3 Drawing Sheets

11
13
14
15
15
18
18
19
20
II
II

RECEIVING HOUSING FOR A HAND-HELD POWER TOOL

BACKGROUND OF THE INVENTION

1. Field of the Invention

The present invention relates to a receiving housing for a hand-held power tool including a first housing part having an opening, a board provided with electronic component and arranged in the first housing part at a distance from the opening, and a second housing part for closing the opening and forming, together with the first housing part, a receiving space.

2. Description of the Prior Art

For controlling a hand-held power tool such as, e.g., a hammer drill, chisel hammer, circular or saber saw, grinder, screw-driving tool or the like, there are provided electronic devices which are arranged in a receiving housing. Such a housing has a first housing part having an opening and a second housing part for closing the opening, with the two housing part forming a receiving space. In the first housing part, a board, which is equipped with electronic components, is arranged at a distance from the opening.

Swiss Patent CH 665 150 A5 discloses a receiving housing for an electrical hand-held tool. The housing has a first tub-shaped housing part having an opening. In the first housing part, there is arranged a board equipped with electronic components such as control elements, optical display elements or with a plug. The board is arranged at a distance from the opening. In order to protect the board, the opening in the first housing part is closed with a cover plate that forms the second housing part. The cover plate is secured on the first housing part with a locking mechanism. The cover plate is transparent at least in the region of the optical display elements so that their light is visible.

The drawback of the known solution consists in that between the first and second housing part, moisture or dust can penetrate in the receiving space, which leads to the malfunction of the electronics.

In order to protect such housings from outside influences, in particular, from penetration of moisture or dust in the receiving space, the receiving space is filled, after connection of the housing parts, with a sealing mass.

The drawback of the known solution consists in that the electronic components which should be visible from outside or mechanically accessible, are also completely sealed.

The object of the invention is to provide a receiving housing of the type discussed above and in which some electronic components are visible from outside or are mechanically accessible and in which the receiving space is sealed for protecting the electronics.

SUMMARY OF THE INVENTION

This and other objects of the present invention, which will become apparent hereinafter, are achieved by providing, in the second housing part, at least one sleeve section the axial length of which at least corresponds to the distance between the board and the opening.

The at least one sleeve section is so arranged on the second housing part that, e.g., an optical display element, which is arranged on the board, is visible from outside or the plug, which is provided on the board, is mechanically accessible. The axial extent of the at least one sleeve section is so selected that upon assembly of the housing parts, at least the free end of the free end section of the sleeve section, is pressed against a side of the board, which provides a circumferential sealing zone. The remaining space of the receiving space is filled after the assembly of both housing parts, with a suitable sealing mass. The circumferential sealing zone blocks the entry of the sleeve section in the inner chamber, which is formed by the at least one sleeve section, so that an electronic component or components located in the inner chamber are not sealed.

Preferably, there is provided an access opening to the inner chamber formed in the at least sleeve section of the second housing part, through which an electronic component provided on the board, e.g., a plug, is mechanically accessible from outside. With to-be-visible from outside, electronic components, such as, e.g., an LED, accessibility is not absolutely necessary, as long as the second housing part is transparent at least in the region of the at least sleeve section.

Advantageously, at least the free end region of the at least one sleeve section is formed of an elastically deformable material. Thereby, upon assembly of the two housing parts, the free end of the free end region of the at least one sleeve section of the second housing part bends slightly backwardly, insuring a reliable sealing between the receiving space and the board and, thus, between the receiving space and the inner chamber provided by the at least one sleeve section. An elastomer, e.g., can be used as the elastic deformable material the free end is made of. Alternatively, the entire at least one sleeve section or the entire second housing part can be formed of an elastically deformable material.

Preferably, the at least one sleeve section has a circumferentially arranged undercut. The undercut advantageously corresponds to the profile of the free edge of the first housing part. A so-formed locking connection enables a simple connection of the second housing part to the first housing part. The locking connections holds the two parts together also during the filling of the remaining receiving space with the sealing mass, sealing the opening in the first housing part and the inner chamber in the sleeve section, preventing outflow of the sealing mass out of the receiving space.

Advantageously, the free end region of the at least one sleeve section widens in a funnel-shaped form, so that upon assembly of the two housing parts, the free end region of the at least one sleeve section bends outwardly, lying at least region wise flatly on the side of the board facing the receiving space, reliably sealing the inner chamber of the at least sleeve section from the receiving space.

Preferably, the wall thickness of the at least one sleeve section diminishes toward the free end of the sleeve section, whereby the free end region becomes easily deformable upon assembly of the two housing parts and easily engages the board with a preload.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

BRIEF DESCRIPTION OF THE DRAWINGS

The drawings show.

In all of the figures of the drawings the same elements are designated with the same reference numerals.

DETAILED DESCRIPTION OF THE PREFERRED EMBODIMENT

Figure 1:
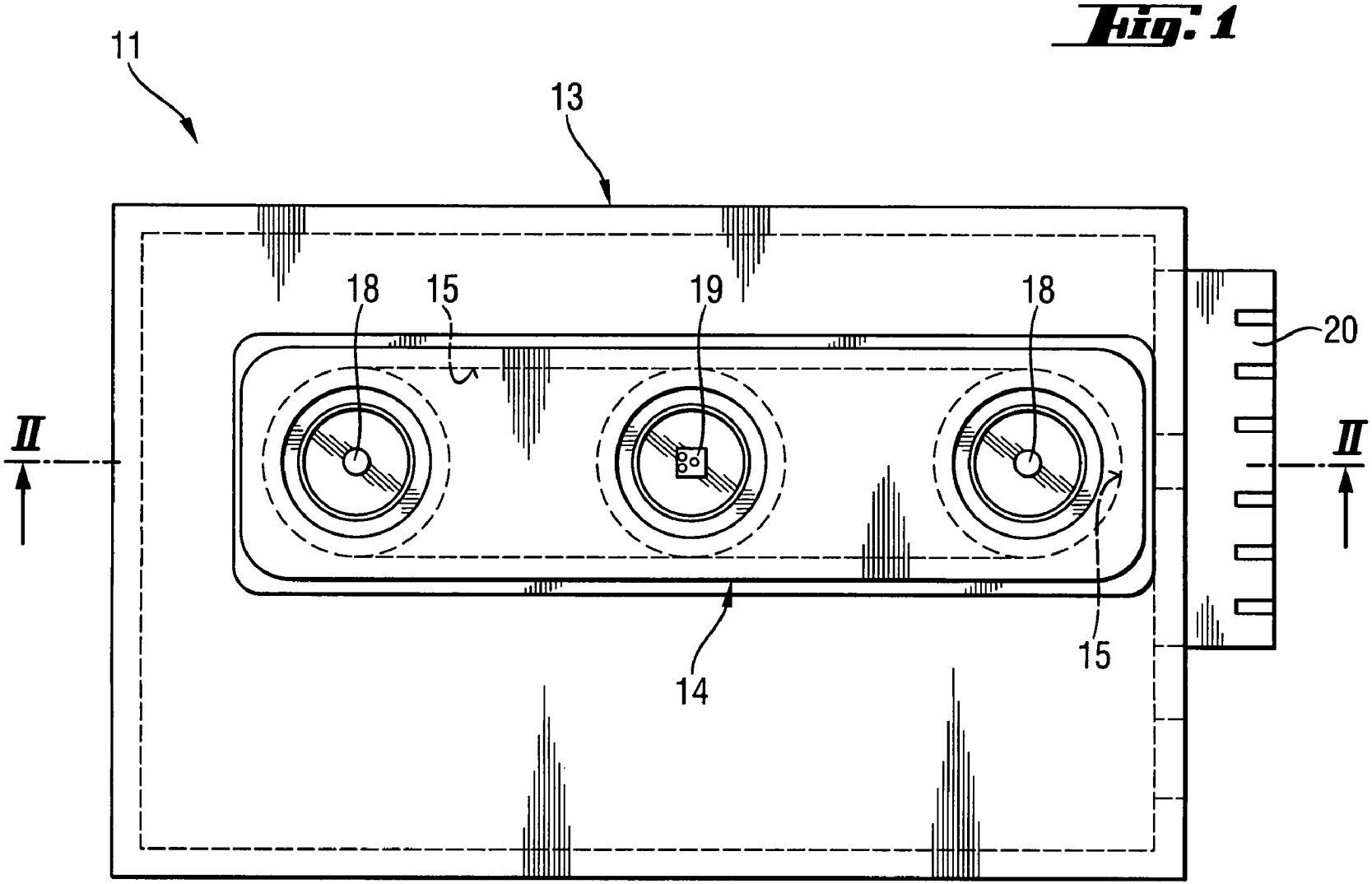
FIG. 1 a plan view of a receiving housing according to the present invention for a hand-held power tool.
Figure 2:
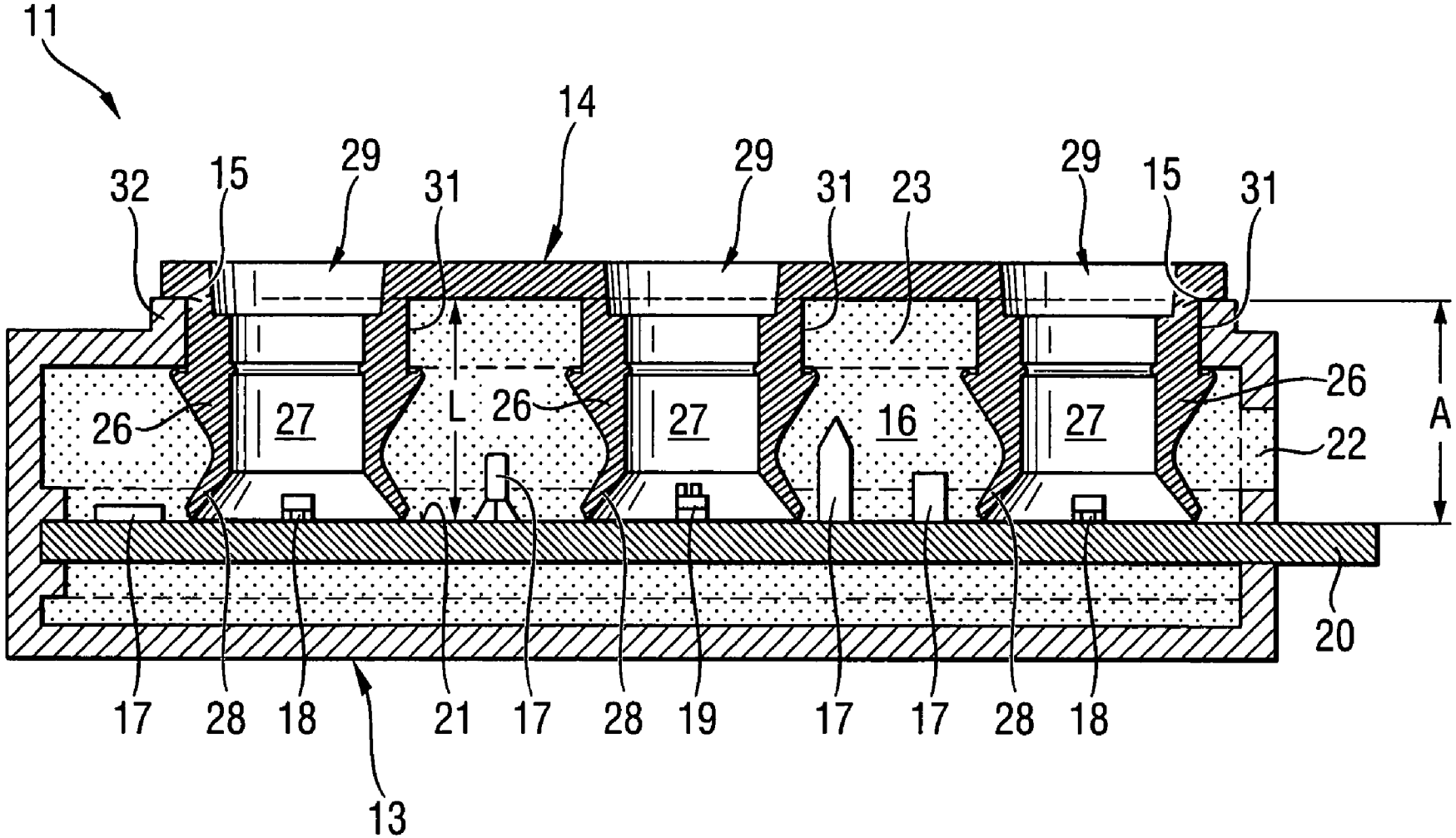
FIG. 2 a longitudinal cross-sectional view of the receiving housing along line II-II in FIG. 1.
Figure 3:
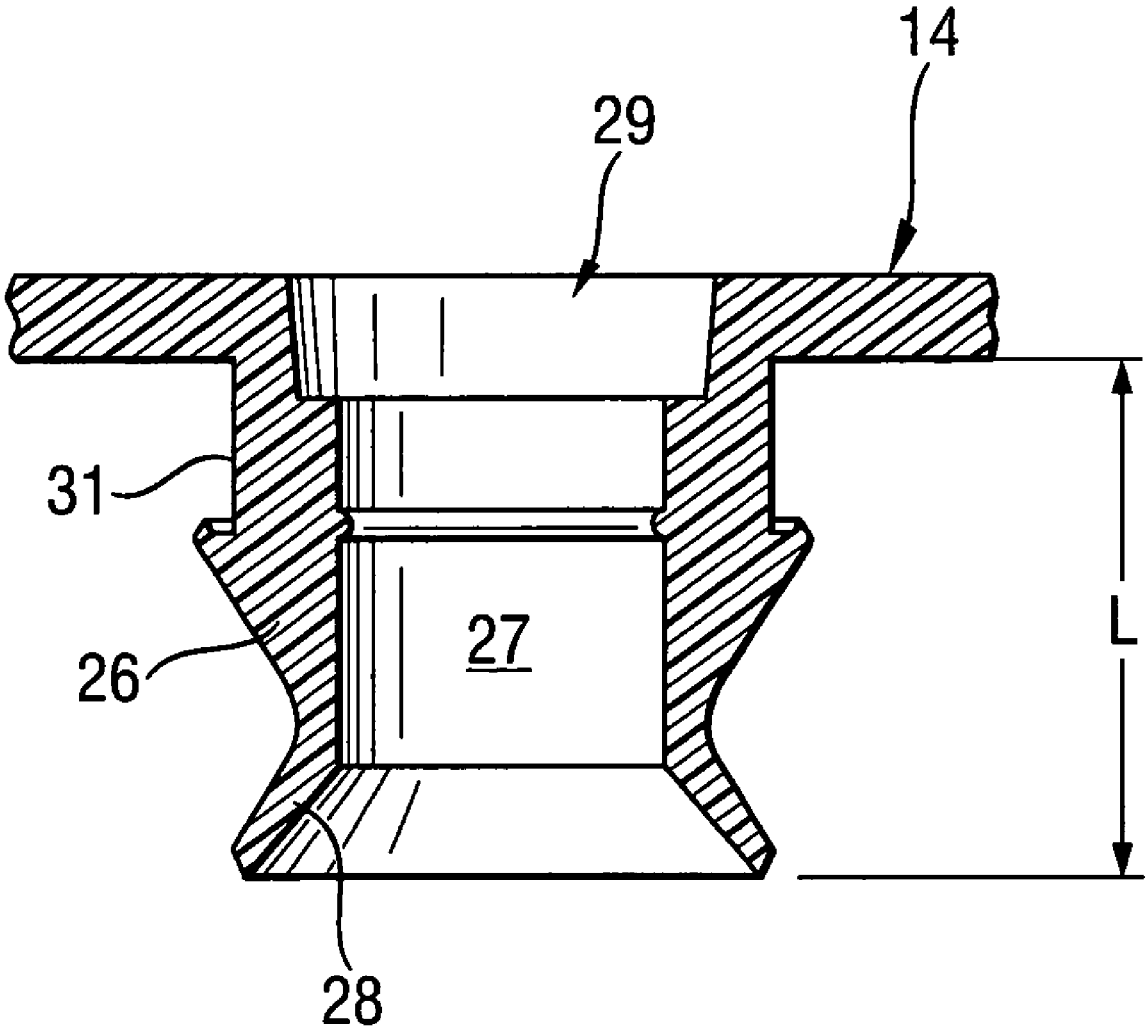
FIG. 3 a cross-sectional view of a detail of the second housing part with a sleeve section at an increased in comparison with FIG. 2, scale.

A receiving housing 11 for a hand-held power tool, not shown, which is shown in FIGS. 1-3, has a first tub-shaped housing part 13 having an opening 15 formed as elongate opening, and a second housing part 14 for closing the opening 15, with the housing parts 13, 14 forming a receiving space 16. In the first housing part 13, there is arranged, at a distance A from the opening 15, a board 20 equipped with electronic components 17, LEDs 18, and a plug 19.

The second housing part 14 is provided with three sleeve sections 26 the axial length L of which is greater than the distance A between the board 20 and the opening 15. Because the axial length L of the sleeve sections 26 corresponds at least to the distance A, the free end regions 28 of the sleeve sections 26 lie, with formation of three inner chambers 27 in an assembled condition of the first housing part 13 and the second housing part 14, on a side 21 of the board 20 over a circumferential sealing area and seal the receiving space 16 relative to the inner chambers 27. In the second housing part 14, there are provided respective access openings 29 which insure access to the inner chambers 27, so that LEDs 18, which are to be placed in the inner chambers 27, are visible from outside, and the plug 19 is mechanically accessible.

The free end regions 28 of the sleeve sections 26 are formed of an elastomeric material and widen in funnel-shaped form, with the wall thickness of the sleeve section 26 decreasing toward the free end. In the embodiment shown in the drawings, the sleeve sections 26 have a hyperbolic outer profile along their axial extent.

In order to form an undercut 31, the sleeve sections 26 have a circumferential depression formed so that it corresponds to the profile of the free end 32 of the first housing part 13. The locking connection, which the undercut 31 provides, insures connection of the second housing part 14 with the first housing part 13 and engagement of the free regions 28 with the side 21 of the board 20 upon filling the receiving space 16 with a sealing compound 23 through a filling opening 22 in the first housing part 13. The sealing compound 23 fills the remaining receiving space 16 after the assembly of the first housing part 13 and the second housing part 14, whereby the not-to-be-viewed and mechanically not accessible electronical components 17 and the board 20, except the regions of the LEDs 18 and the plug 19, become sealed. Thus, the moisture and dirt, which can lead to a faulty function of the electronics, cannot penetrate in the receiving space 16.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments with the spirit and scope of the present invention as defined by the appended claims.

What is claimed is:

1. A receiving housing for a hand-held power tool, comprising a first housing part (13) having an opening (15); a board (20) provided with electronic component (17, 18, 19) and arranged in the first housing part (13) at a distance (A) from the opening (15); and a second housing part (14) for closing the opening (15) and forming, together with the first housing part (13), a receiving space (16); a sealing compound (23) filling the receiving space (16), the second housing part (14) having at least one sleeve section (26) an axial length (L) of which at least corresponds to the distance (A) between the board (20) and the opening (15) and which forms an inner chamber (27), the second housing part (14) further having an access opening (29) to the inner chamber (27) formed by the at least one sleeve section (26), and the at least one sleeve section (26) having an end region (28) formed of an elastically deformable material for sealing the inner chamber (27) against the sealing compound.

2. A receiving housing according to claim 1, wherein the at least one sleeve section (26) has a circumferential undercut (31).

3. A receiving housing according to claim 1, wherein the at least one sleeve section (26) has a funnel-shaped free end region.

4. A receiving housing according to claim 1, wherein a wall thickness of the at least one sleeve section (16) is reduced toward a free end thereof.

* * * * *